United States Patent [19]

Nakamura et al.

[11] Patent Number: 4,726,738

[45] Date of Patent: Feb. 23, 1988

[54] MOTOR-DRIVEN COMPRESSOR PROVIDED WITH TORQUE CONTROL DEVICE

[75] Inventors: Yozo Nakamura, Ibaraki; Naoyuki Tanaka, Abiko; Shigeru Machida; Akira Arai, both of Ibaraki; Yoshihisa Uneyama, Tochigi; Kazuo Ikeda, Tochigi; Akihiko Ishiyama, Tochigi; Takeoshi Katoh, Ibaraki; Tunehiro Endo, Hitachiota; Hiroaki Hata, Tochigi, all of Japan

[73] Assignee: Hitachi, Ltd., Tokyo, Japan

[21] Appl. No.: 817,670

[22] Filed: Jan. 10, 1986

[30] Foreign Application Priority Data

Jan. 16, 1985 [JP] Japan ..... 60-5477
Aug. 23, 1985 [JP] Japan ..... 60-184170

[51] Int. Cl.[4] ..... F04B 49/06; H02P 5/28

[52] U.S. Cl. ..... 417/22; 417/42; 417/45; 318/432; 318/798

[58] Field of Search ..... 417/1, 14, 18, 22, 32, 417/42, 45, 53; 62/228.4; 318/721–723, 798, 432

[56] References Cited

U.S. PATENT DOCUMENTS

| | | | |
|---|---|---|---|
| 2,985,010 | 5/1961 | Piltz | 417/1 |
| 4,015,182 | 3/1977 | Erdman | 62/228.4 |
| 4,066,938 | 1/1978 | Turnbull | 318/721 X |
| 4,171,931 | 10/1979 | Harada | 417/22 |
| 4,223,261 | 9/1980 | White | 318/722 X |
| 4,240,020 | 12/1980 | Okuyama et al. | 318/722 X |
| 4,262,241 | 4/1981 | Azusawa | 318/722 X |
| 4,276,504 | 6/1981 | Nagase et al. | 318/722 X |
| 4,384,825 | 5/1983 | Thomas et al. | 417/42 X |
| 4,496,893 | 1/1985 | Nakano et al. | 318/721 |
| 4,511,827 | 4/1985 | Morinaga et al. | 318/721 X |
| 4,604,036 | 8/1986 | Sutou et al. | 417/18 |

FOREIGN PATENT DOCUMENTS

| | | | |
|---|---|---|---|
| 119403 | 10/1978 | Japan | 417/1 |
| 43281 | 3/1980 | Japan | 417/45 |

*Primary Examiner*—Carlton R. Croyle
*Assistant Examiner*—Paul F. Neils
*Attorney, Agent, or Firm*—Antonelli, Terry & Wands

[57] ABSTRACT

A motor-driven compressor used as a compressor or high-pressure gas generator for a refrigerating cycle, in which the output torque of the electric motor for driving the compressor is controlled so as to make the output torque agree with the load torque required for performing compression in any revolutional angular position of the driving main shaft to thereby reduce revolutional torsional vibrations caused by disagreement between the load torque and the output torque.

20 Claims, 19 Drawing Figures

MOTOR-DRIVEN COMPRESSOR PROVIDED WITH TORQUE CONTROL DEVICE

BACKGROUND OF THE INVENTION

1. Field of the Invention

The present invention generally relates to a motor-driven compressor used as compressing means or high-pressure gas generating means for a refrigerating cycle in an air conditioner, a refrigerator box for home use, or the like, and particularly relates to a motor-driven compressor provided with a torque control device suitable for a motor-driven compressor in which a driving revolutional velocity is made variable.

2. Description of the Prior Art

For example, U.S. Pat. No. 4,373,356 discloses such a technique that a plurality of springs are interposed between a hermetic casing and either a compressor or an electric motor when the electric motor and the compressor are disposed in the hermetic casing so as to reduce vibrations generated in the compressor. Further, there has been known such a technique that an electric motor and a compressor are fixed to a closed casing and the hermetic casing is supported through springs so as to reduce vibrations similarly to the foregoing technique.

In these conventional techniques, however, there have been such disadvantages that generation per se of the vibrations can not be suppressed, and it is difficult to suppress the vibrations to an extent they do not matter in practical use by utilizing elastic bodies such as springs, rubber members, or the like.

SUMMARY OF THE INVENTION

It is therefore an object of the present invention to provide a motor-driven compressor provided with an output torque control device in which it is possible to reduce vibrations, particularly, torsional vibrations in the revolutional direction of the compressor to an extent they do not matter in practical use.

It is another object of the present invention to provide a motor-driven compressor provided with an output torque control device, in which torsional vibrations can be substantially prevented from occurring.

It is a further object of the present invention to provide a motor-driven compressor provided with an output torque control device, in which it is possible to suppress generation per se of torsional vibrations.

The present invention is featured in that in a compressor connected to an electric motor through a main shaft so as to be driven by the electric motor, there is provided a torque control device in which the angle of one revolution of the main shaft is divided into a plurality of regions and a difference between an angular velocity of the main shaft detected in each of the divisional regions and a reference angular velocity is obtained so that the output torque of the electric motor is controlled in accordance with the obtained difference in each of the divisional region.

The above and other objects and features of the invention will appear more fully hereinafter from a consideration of the following descriptions taken in connection with the accompanying drawings.

BRIEF DESCRIPTION OF THE DRAWINGS

The drawings are diagrams for explaining embodiments according to the present invention, in which.

DESCRIPTION OF THE PREFERRED EMBODIMENTS

Figure 1:
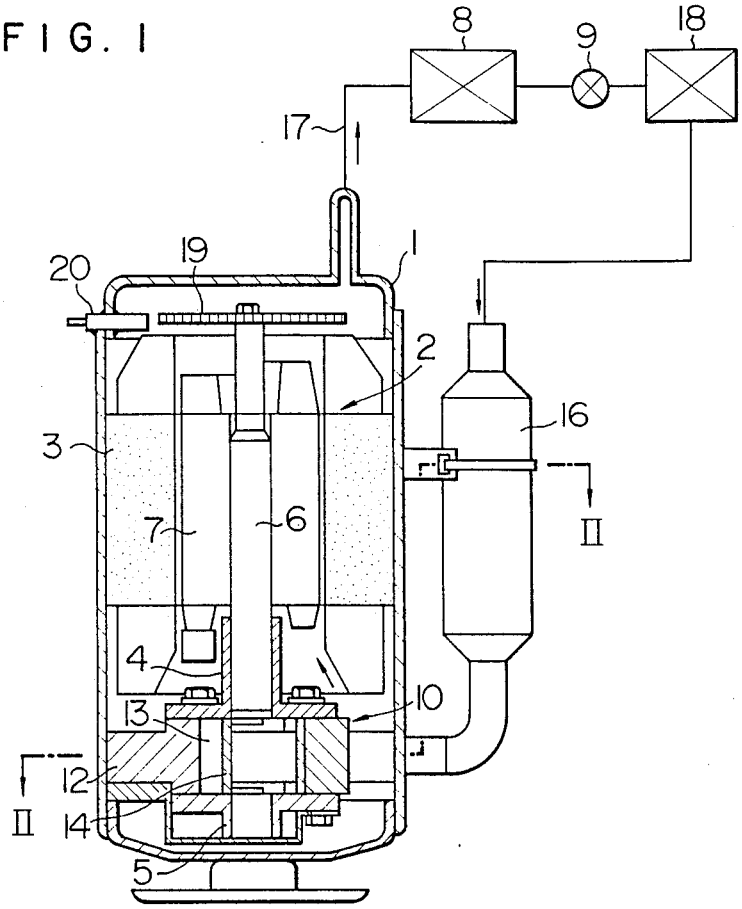
FIG. 1 is a whole system diagram showing a first embodiment according to the present invention.

FIGS. 1 to 10 are explanatory diagrams showing a first embodiment according to the present invention.

Referring to FIGS. 1 to 4, a rotary compressor has a casing 1 in which an electric motor 2 and a compressor 10 are housed. The motor 2 is constituted mainly by a stator 3 fixed to the casing 1, a main shaft 6 supported by a main and an end bearing 4 and 5 respectively, and a rotor 7 fixed to the main shaft 6. The compressor 10 is constituted mainly by a cylinder block 12 fixed to the casing 1, and a roller 14 associated with the main shaft 6 and arranged in the cylinder block 12 to define a compressing operation chamber 13. The reference numeral 15 designates a vane arranged to project into the compressing operation chamber 13 so as to abut on the surface of the roller 14, the vane being urged against the roller 14 by a spring 11 to thereby always maintain the abutting state. The reference numeral 16 designates a suction accumulator 16. Upon rotating the main shaft 6, a refrigerant gas is sucked by the suction accumulator 16, pressurized in the compressing operation chamber 13 to have a predetermined pressure, caused to flow in the direction shown by an arrow in FIG. 1, and discharged into a condenser 8 connected to the casing 1 through a conduit 17. The condenser 8 is connected to an evaporator 18 through an expansion valve 9, and an outlet of the evaporator 18 is connected to the suction accumulator 16. The upper end portion of the main shaft 6 constituting the compressor 10 extends upward, and a gear 19 is fixed to the extended portion so as to rotate together the main shaft 6. An electromagnetic pickup 20 providing a magnetic field is fixed to the casing 1 in opposition to the gear 19.

Figure 5:
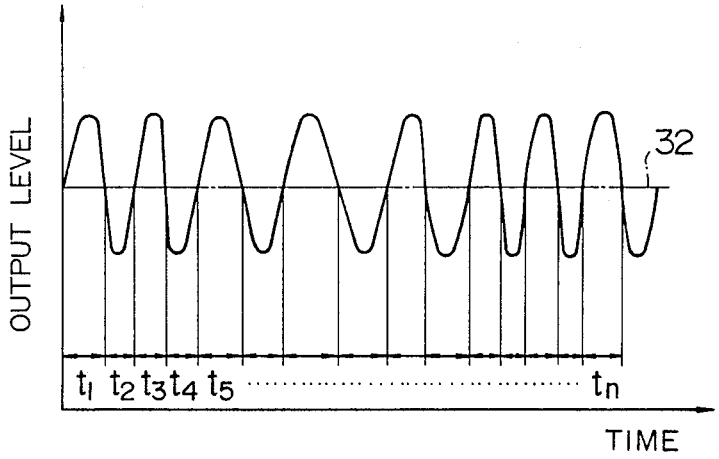
FIG. 5 is a diagram showing a detection signal provided from the electromagnetic pickup.
Figure 6:
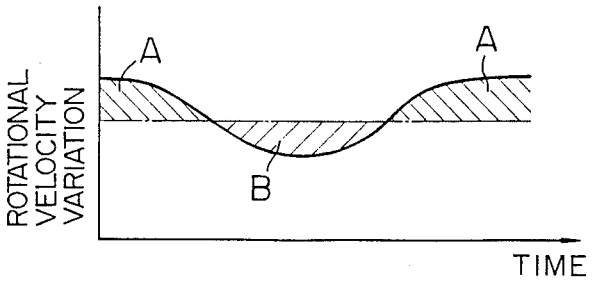
FIG. 6 is a diagram showing a state where a revolutional velocity of the main shaft is changed.

This electromagnetic pickup 20 produces a signal as shown in FIG. 5 in accordance with the revolutional velocity of the main shaft 6. If a time t required for the signal from a point at which the signal intersects a reference line 32 (a center line of output levels of the signal as shown in FIG. 5) to another point at which the signal intersects again the reference line 32 is measured, an instantaneous revolutional velocity of the main shaft 6 can be obtained on the basis of the thus obtained time t and the number of teeth of the gear 19. FIG. 6 shows the state of fluctuation in revolutional velocity of the main shaft 6 obtained on the basis of the revolutional velocity signal shown in FIG. 5, in which symbols A and B designate leading and lagging regions respectively. Further, a mean revolutional velocity can be obtained on the basis of mean time t,0070
and the number of teeth m of the gear 19, and the leading/lagging quantity $\omega$ can be obtained on the basis of the expression $\omega\alpha t_a\ (t_i/t_n-1)$.

The output side of the electromagnetic pickup 20 is connected to an operation storage circuit 22 through a waveform shaping circuit 21. The electric motor 2 is connected to a revolutional velocity control circuit 23 which is in turn connected to a base driver 24. A torque control circuit 25 generates a chopping signal on the basis of a deviation signal representing the deviation in the time taken for revolution or in the angular velocity in each of the divisional revolutional angular regions, the chopping being transferred to the base driver 24.

The revolutional velocity control circuit 23 is a 120° conduction type inverter constituted by transistors $TR_1$–$TR_6$ and reflux diodes $D_1$–$D_6$, and the respective current conduction periods of 120° of the transistors $TR_1$–$TR_3$ on the positive side of a DC voltage $E_d$ are subject to pulse-modulation to perform chopping operations so as to control the AC output voltage of the revolutional velocity control circuit 23.

Further, a low value resistor $R_1$ is connected between a common emitter terminal of the transistors $TR_4$–$TR_6$ and a common anode terminal of the reflux diodes $D_4$–$D_6$.

The electric motor 2 is constituted by a brushless DC motor, that is, a synchronous motor having a field system constituted by two-pole permanent magnets.

A winding current flowing in an armature winding of the electric motor 2 flows also in the resistor $R_1$, and therefore the winding current $I_L$ is detected in the form of a voltage drop across the resistor $R_1$.

A control section for controlling the revolutional or angular velocity of the electric motor 2 is constituted by the operation storage circuit 22, a pole position detection circuit 26 for detecting a pole position of the rotor of the electric motor 2, the torque control circuit 25 for making the angular velocity of the main shaft 6 variable by changing the torque of the electric motor 2 a plurality of times in every one revolution of the main shaft 6, the base driver 24 for controlling the transistors $TR_1$–$TR_4$, a velocity command circuit 27 for giving a command of desired revolutional velocity to the operation storage circuit 22, the electromagnetic pickup 20 for detecting a fluctuation in revolutional velocity of the main shaft 6 of the rotor, and the waveform shaping circuit 21.

The pole position detection circuit 26 forms a position detection signal $S_2$ corresponding to a rotor angular position from the armature winding terminal voltages $V_A$–$V_C$ by using a filter circuit.

The operation storage circuit 22 is constituted by a CPU **22*a*, a ROM 22*b*, a RAM 22*c***, an interface, and the like, which are connected to each other through an address bus, a data bus, and a control bus which are not shown in the drawing.

Figure 4:
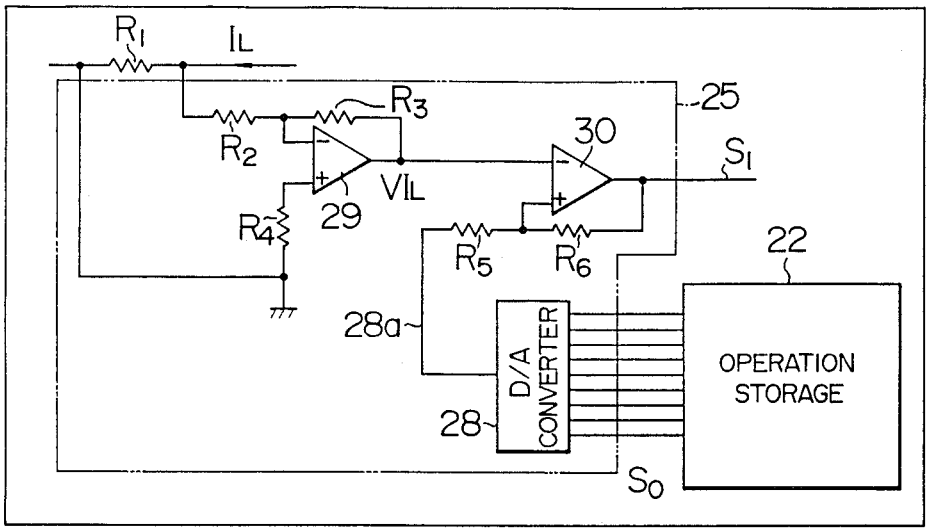
FIG. 4 is a diagram showing the torque control circuit in detail.

FIG. 4 shows an embodiment of the torque control circuit 25 in detail. The torque control circuit 25 is constituted by a D/A converter 28 functioning as a current command circuit, an amplifier 29 functioning as a current detection circuit, and a comparator 30 having a hysteresis characteristic and functioning as a comparing circuit.

Eight bits of angular velocity deviation data or time deviation data $S_0$ read out of the RAM **22*c* in the operation storage circuit 22 are converted into an analog value by the D/A converter 28 to provide a commanded current value 28*a* shown in FIG. 4**.

The winding current $I_L$ obtained in the form of the voltage drop across the resistor $R_1$ is amplified by the amplifier 29 to provide an actually detected current value $V_{IL}$, and the thus obtained actually detected current value $V_{IL}$ is compared with the commanded current value **28*a* in the comparator 30 so that the comparator 30** produces a chopping signal $S_1$ as its output.

Next, the operation of this embodiment will be described.

Figure 2:
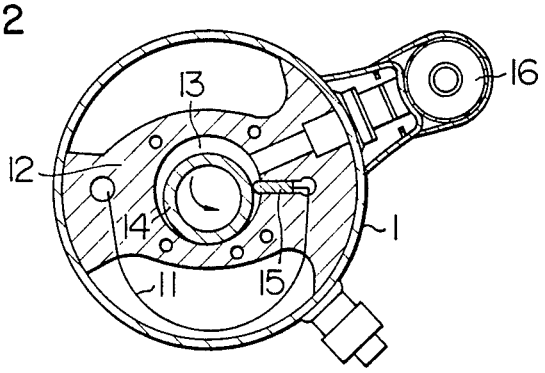
FIG. 2 is a cross-section taken along a line II—II of FIG. 1.
Figure 3:
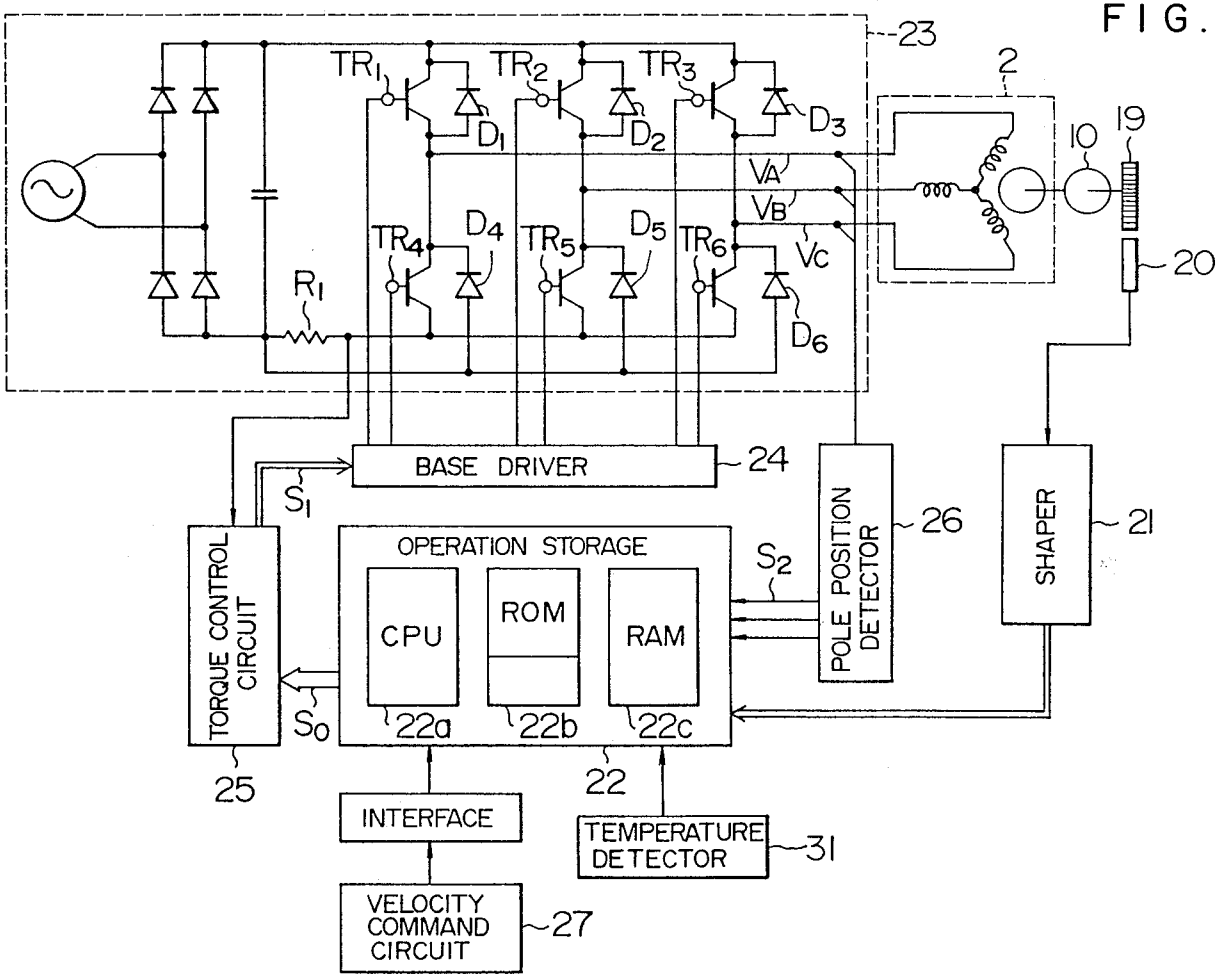
FIG. 3 is a diagram showing the control circuit.

In FIGS. 1, 2, and 3, upon starting, the electric motor 2 is accelerated step by step till the revolutional velocity thereof reaches a setting value, for example, 3,000 r.p.m, set in advance by the revolutional velocity control circuit 23. After the revolutional velocity has reached the setting value, if the temperature T in the room to be cooled actually detected by a temperature detector 31 disposed in the vicinity of the evaporator 18 is different from a desired value $t_0$ (setting of which can be desirably changed), the actual revolutional velocity N of the electric motor 2 is increased/decreased to reduce the temperature difference.

Figure 7:
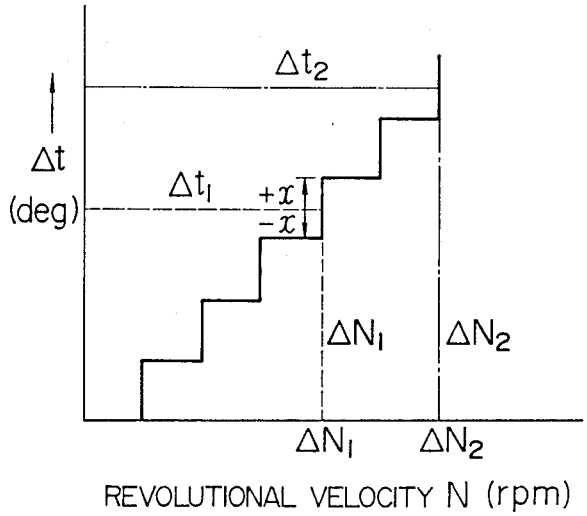
FIGS. 7, 8 and 9 are diagrams for explaining operations.
Figure 8:
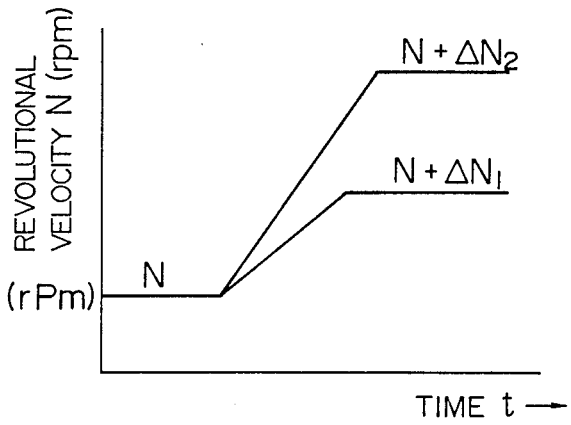

Referring to FIGS. 7 and 8, detailed description will be made as to the foregoing operation.

As shown in FIG. 7, in the case where the temperature T detected by the temperature detector 31 is higher than the set value $t_0$ by a value $\Delta t_1$ (having a width of $\pm x$), $\Delta N_1$ is set in the operation storage circuit 22 so that the electric motor 2 is accelerated so as to increase the actual revolutional velocity N by the set value $\Delta N_1$, while in the case where the detected temperature T is higher than the set value $t_0$ by a value $\Delta t_2$, $\Delta N_2$ is set, similarly to the foregoing case.

As shown in FIG. 8, the rate of change in revolutional velocity relative to time varies in accordance with a quantity of variation $\Delta N$ in the actual revolutional velocity N such that it becomes large as the quantity of variation $\Delta N$ increases. In this embodiment, the electric motor 2 is of the type in which the revolutional velocity thereof can be changed continuously or stepwise within a range from about 700 r.p.m. to 7,000 r.p.m., so that if there occurs a difference between the set temperature $t_0$ and the actual temperature T detected by the temperature detector 31 in the case the electric motor 2 is being driven at any revolutional velocity within the range, the revolutional velocity of the electric motor 2 is increased/decreased so as to make the difference approximate zero.

Next, taking the case where one compressing cycle (suction, compression, and discharge) is performed during one revolution of the main shaft 6 as an example, the operation in the case where the output torque of the motor acting as the driving force for the compressing operation is controlled in accordance with the change in compressing or load torque required for compressing gas will be described. To make the output torque of the electric motor 2 continuously change in a short time during which the main shaft 6 is once rotated, makes it difficult to attain such a purpose of performing torque control that a difference between the compressing or load torque and the output torque is made to be substantially zero in any revolutional angular position of the main shaft 6, and makes the circuit arrangement for controlling the output torque extraordinarily complicated. In the embodiment according to the present invention, in order to eliminate those foregoing disadvantages, the angle of one revolution ($2\pi$ radian) of the main shaft 6 is divided into a plurality of divisional revolution angular regions, for example, equal in number to a product of the number of magnetic poles of the electric motor 2 and the number of phases of the same, so that the torque control is performed in each of these divisional revolution angular regions. For example, assuming that the number of magnetic poles and phases of the electric motor 2 is selected to be two and three respectively, the angle of one revolution is equally divided into six regions, and assuming that the respective numbers of the magnetic poles and phases of the motor is selected to be two and six respectively, the revolutional angle of one revolution is equally divided into twelve revolutional angular regions. Further, since the output torque is easily controlled by selecting the number of teeth of the gear 19 in accordance with the number of divisions, that is, by selecting the number of divisional revolutional angular regions, in the embodiments according to the present invention, the number of teeth of the gear 19 is selected to be a value of an integer times the number of divisions, that is, 48 teeth.

Description will be made as to the case where the revolutional angle of one revolution ($2\pi$ radian) of the main shaft 6 is equally divided into twelve regions, hereunder.

Figure 9:
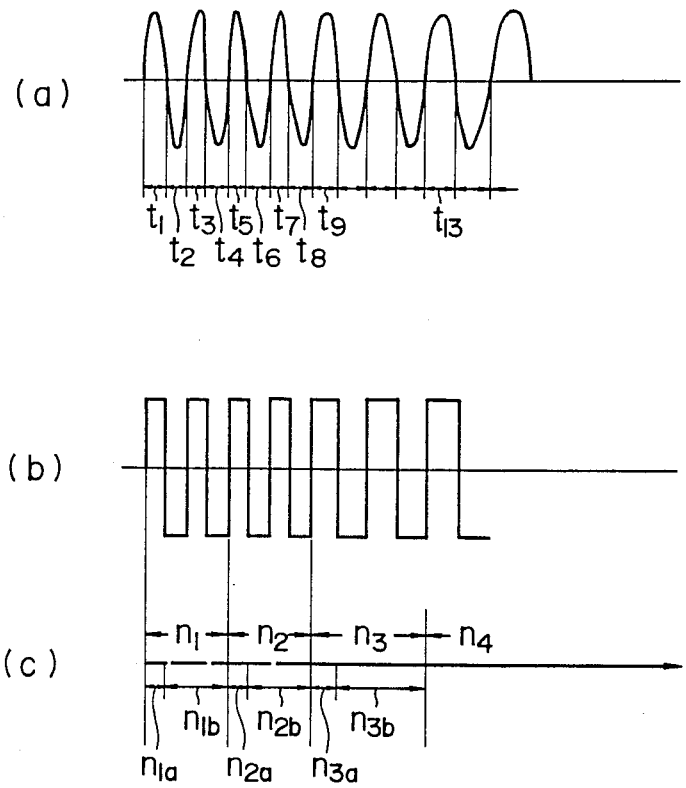

In operation, a signal having such a sinusoidal waveform as shown in FIG. 9(*a*) (similarly to FIG. 5) is produced from the electromagnetic pickup 20. This sinusoidal waveform signal is shaped into a rectangular waveform signal as shown in FIG. 9(*b*) by the waveform shaping circuit 21 and applied to the operation storage circuit 22 in which a reference time $T_0$ required for making the main shaft 6 rotate by the revolutional angle corresponding to one tooth of the gear 19 is obtained on the basis of the revolutional velocity data carried on the sinusoidal waveform signal, and this reference time $T_0$ and each of the times $t_1$, $t_5$, $t_9$ . . . during which the rectangular wave crosses a reference axis are compared with each other to obtain the respective deviations ($T_0 \sim t_1$), ($T_0 \sim t_5$), ($T_0 \sim t_9$), . . . Next, a desired value of the output torque is calculated on the basis of each of the deviations ($T_0 \sim t_1$), ($T_0 \sim t_5$), ($T_0 \sim t_9$), . . . , so that the desired value of the output torque becomes equal to the mean value of the load torque in each of the divisional revolution angular regions corresponding to the deviations ($T_0 \sim t_1$), ($T_0 \sim t_5$), ($T_0 \sim t_9$), . . . Further, a torque control signal $S_0$ corresponding to the obtained desired value of the output torque is formed and transferred to the torque control circuit 25.

Here, detailed description will be made as to an example of the operation for obtaining the desired value of the output torque. For example, in the case where each of the obtained deviations ($T_0 \sim t_1$), ($T_0 \sim t_5$), ($T_0 \sim t_9$), . . . shows a large value, this fact means that the difference between the load torque and the output torque at that time is large, that is, the load torque is large and the rate of change in load torque is steep.

Therefore, if the desired value of the output torque is calculated such that it becomes larger than the actual value of the load torque in each detection of the deviation by the value of each of deviations ($T_0 \sim t_1$), ($T_0 \sim t_5$), ($T_0 \sim t_9$), . . . , the desired output torque is made, as the result, to be an approximate mean value of the load torque in each of the divisional revolution angular regions corresponding the deviations ($T_0 \sim t_1$), ($T_0 \sim t_5$), ($T_0 \sim t_9$), . . . Thus, the desired value of the output torque is made substantially equal to the mean value of the load torque in each divisional revolution angular region. In the torque control circuit 25, the torque control signal $S_0$ and the detected value $V_{IL}$ of the actual current in the electric motor 2 are compared with each other so as to produce a chopping signal $S_1$ to apply it to the base driver 24 so that in the case where $S_0 > V_{IL}$, that is, when the output torque is smaller than the load torque, the transistor $TR_1$ is maintained in its on-state, while in the case where $S_0 < V_{IL}$, that is, when the output torque is larger than the load torque, the transistor $TR_1$ is held in its off-state. The base driver 24 is operated so as to continuously increase a base current flowing into the base of the transistor $TR_1$ in the revolutional velocity control circuit 23 in a period during which the chopping signal $S_1$ representing the on-state is transferred, while operated so as to continuously decrease the base current flowing in the transistor $TR_1$ in the revolutional velocity control circuit 23 in a period during which the chopping signal $S_1$ representing the off-state is transferred. In the first divisional revolutional angular region $n_1$, the time $t_1$ required for making the main shaft 6 rotate by the revolutional angle corresponding to the first one of the teeth of the gear 19 is detected in the first region $n_{1a}$ of the region $n_1$ as shown in FIG. 9(*c*). The time $t_1$ detected in this detection region $n_1a$ is processed in such a manner as described above, and on the basis of the result of this processing the torque control is effected onto the residual control region $n_{1b}$ of the region $n_1$ excepting the first detection region $n_{1a}$ therefrom and the next divisional revolution angular region, that is, the second detection region $n_{2a}$. The output torque of the electric motor 2 is controlled by the foregoing operation such that the difference between the output torque and the load torque is made to be substantially zero in the first divisional revolution angular region $n_1$. In the second divisional revolutional angular region $n_2$, the time $t_5$ required for making the main shaft 6 rotate by the revolutional angle corresponding to the fifth one of the teeth of the gear 19 is read in, while in the third divisional revolutional angular region $n_3$, the time $t_9$ required for making the main shaft 6 rotate by the revolutional angle corresponding to the ninth one of the teeth of the gear 19 is read in, and the operation is performed in the same manner as described above in each of the divisional revolutional angular regions so that the output torque of the electric motor 2 is controlled so as to make the difference between the load torque and the output torque be substantially zero in each of the divisional revolution angular regions.

Figure 10:
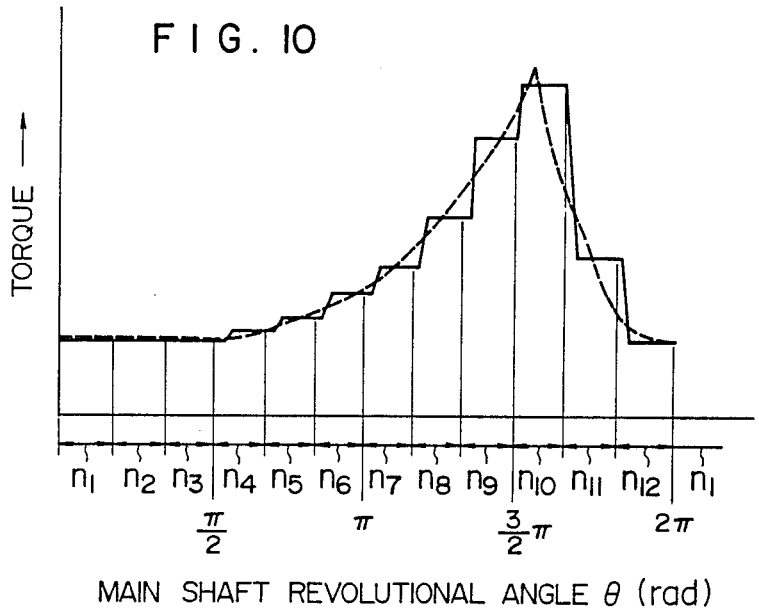
FIG. 10 is a diagram showing the relationship between the load torque and the output torque.

FIG. 10 shows the results obtained by performing the torque control in such a manner as described above. In the drawing, the abscissa and the ordinate represent the revolutional angle (radian) of the main shaft 6 and the torque respectively, and the solid and dotted lines represent the changes in output torque of the electric motor 2 and load torque respectively.

Figure 11:
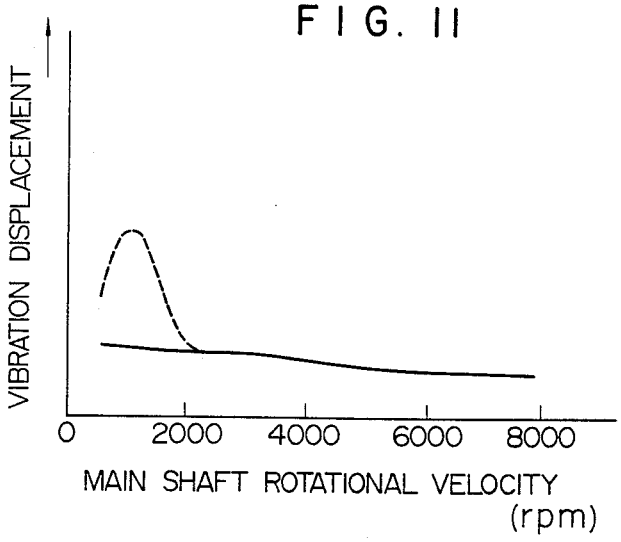
FIG. 11 is a diagram showing a characteristic of the torsional vibration relative to the revolutional velocity.

FIG. 11 shows a characteristic of the torsional vibration relative to the change in revolutional velocity of the main shaft of the motor-driven compressor to which the present invention is applied. According to the present invention, even in the region of revolutional velocity not larger than 2,000 r.p.m., that is, in the range of revolutional velocity from 700 r.p.m. to 2,000 r.p.m. it is possible to make the vibration characteristic substantially the same as that in the region of the revolutional velocity equal to 2,000 r.p.m. or more. Accordingly, in the foregoing embodiment, it is effective that the torque control in each of the divisional revolution angular regions is performed only in a region of revolutional velocity in which large torsional vibration may be caused, for example, in a region of revolutional velocity not larger than about 2,000 r.p.m., while not performed in other regions of this region.

Further, in FIG. 11, the dotted line represents a vibration characteristic in the conventional motor-driven compressor.

Figure 12:
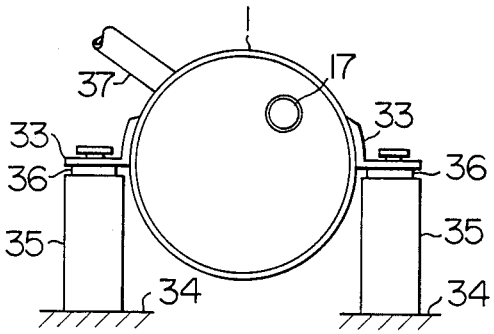
FIG. 12 is a front view showing a main part of a second embodiment according to the present invention.
Figure 13:
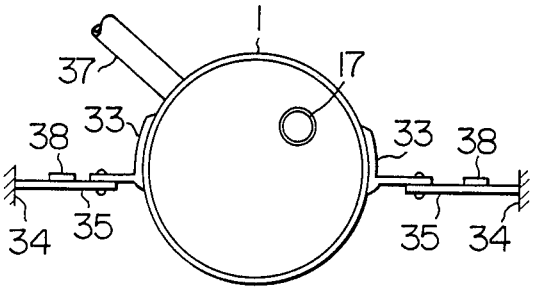
FIG. 13 is a front view showing a main part of a third embodiment according to the present invention.

FIGS. 12 and 13 show second and third embodiments according to the present invention respectively.

FIG. 12 shows a main part of the second embodiment in which attachment jigs 33 are attached onto a casing 1 and supported by supporting members 35 disposed on bases 34 so as to horizontally orient a compressor, and respective load detectors 36 are interposed between the supporting members 35 and the associated attachment jigs 33. Further, the reference numeral 37 designates a suction pipe.

FIG. 13 shows a main part of the third embodiment arranged such that respective attachment jigs 33 attached onto a casing 1 are supported by supporting members 35 fixed to bases 34 and respective distortion detectors 38 are disposed on the supporting members 35.

Figure 14:
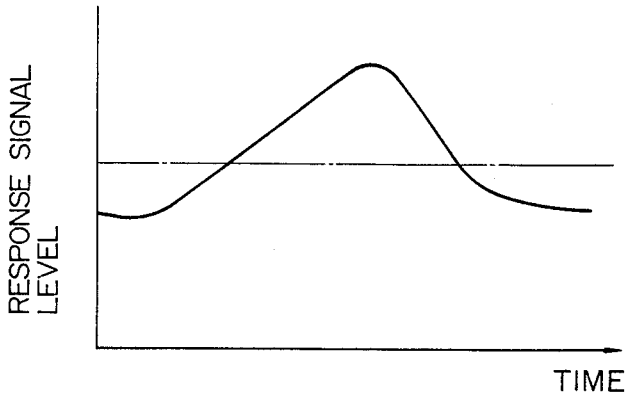
FIG. 14 is a diagram showing respective response signals received by the load detector and the distortion detector used in the second and third embodiments.

In driving the compressor, in each of the second and third embodiments, revolutional vibrations are induced in the casing 1 and the respective detectors 36 and 38 receive response signals (representing changes in load and distortion in the second and third embodiments respectively) as shown in FIG. 14. It has been found from the experimental results by the inventors of the present invention that these response signals correspond to the load torque (see solid line in FIG. 10) of the compressor. Accordingly, also in each of the second and third embodiments, it is possible to suppress the vibrations in the compressor by performing control so as to make the response signals shown in FIG. 14 be substantially zero by using the same control device 8 (see FIG. 3) as that shown in the first embodiment. Further, although the compressor is horizontally oriented in each of the second and third embodiments of FIGS. 12 and 13, the present invention is not limited to this, and the compressor may be, alternatively, vertically or slantingly oriented.

Further, the present invention is intended to control the output torque of an electromotive element to be in agreement with the load torque so as to reduce revolutional vibrations in a revolutional system. Therefore, the present invention is not restricted to the case of a compressor provided as a load, but can be applied to any revolutional system in which the load torque varies.

Furthermore, upon performing the torque control, if an allowance may be provided in the quantity of reduction of the revolutional vibration, it is not always necessary to make the output torque agree with the load torque, and it may be effective to suppress the vibrations if the control is performed such that an output torque pattern in every cycle is approximated to a load torque pattern.

Figure 15:
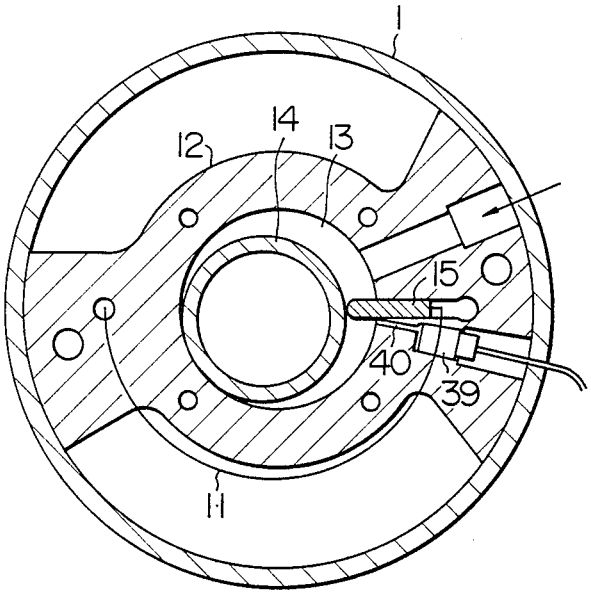
FIG. 15 is a cross-section showing a main part of a fourth embodiment according to the represent invention.
Figure 16:
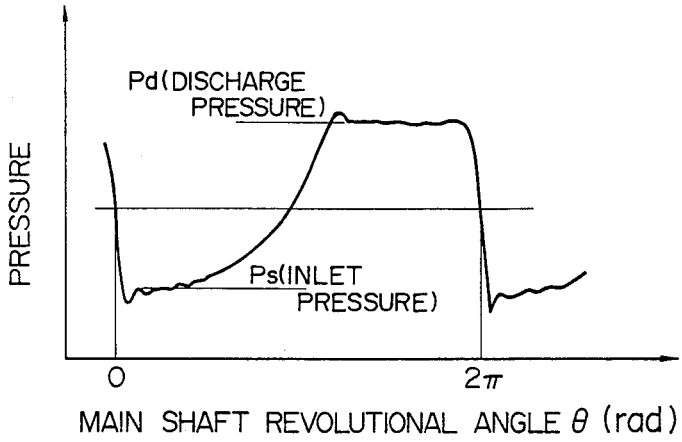
FIG. 16 is a diagram showing a change in pressure in the compressing chamber.
Figure 17:
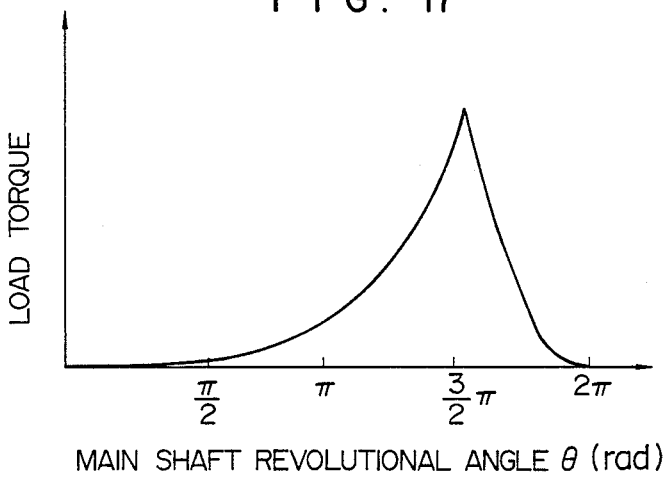
FIG. 17 is a diagram showing a change in load torque.

FIG. 15 shows a fourth embodiment according to the present invention. In the drawing, the reference numeral 39 designates a pressure sensor for detecting a change in pressure of a gas in a compression operating chamber, the pressure sensor 39 being disposed in the vicinity of a discharge port of a cylinder. Other parts in the fourth embodiment are the same as those in the compressor of the first embodiment (see FIGS. 1 and 2). In FIG. 15, therefore, those parts corresponding to those in FIGS. 1 and 2 are correspondingly referenced and the description is omitted. Further, the reference numeral 40 designates a pressure conducting hole extending from the compression operating chamber 13 to the discharge port. The change in pressure in the compression operating chamber 13, as shown in FIG. 16, is detected by the pressure sensor 39. The pressure sensor 39 is connected to an operation storage circuit 22 in a torque control device 25 as shown in FIG. 3, and the change in pressure is operated in the operation storage circuit 22 to obtain a change in load torque as shown in FIG. 17. A signal corresponding to the degree of the load torque is produced to the torque control circuit 25 and the signal is used instead of the foregoing deviation signal $S_0$.

Other operations are performed in the same manner as in the first embodiment.

Figure 18:
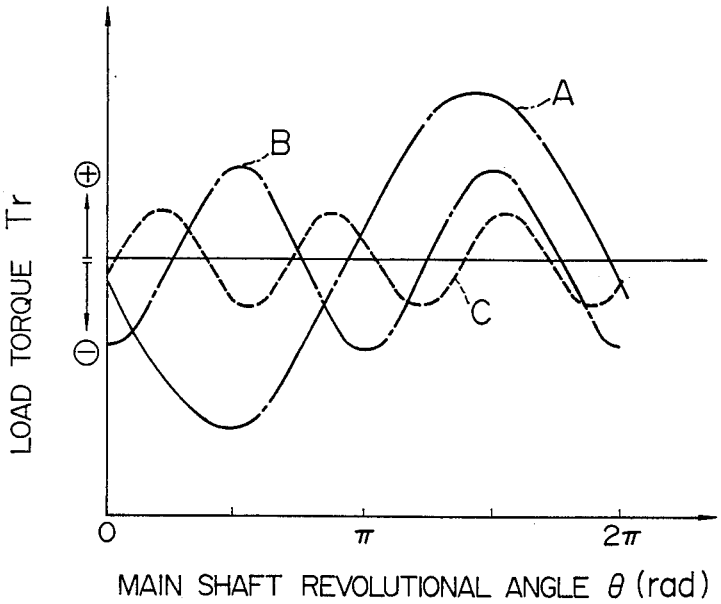
FIG. 18 is a diagram showing Fourier development of the load torque.
Figure 19:
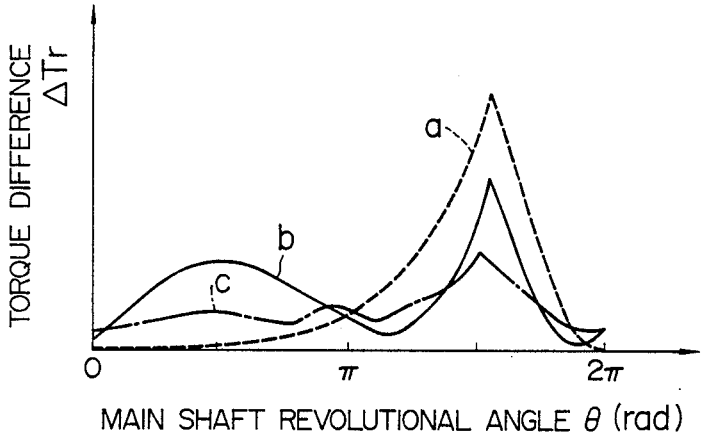
FIG. 19 is a diagram showing the relationship between the output torque and the load torque.

Although the operation storage circuit 22 receives the signal from the pressure sensor 39 and produces the signal corresponding to the degree of the load torque of the compressor, it is not always necessary to make the signal correspond to the degree of the load torque, but it is sufficient to produce any signal on the basis of which the output torque is made to have a value in a range within which the revolutional vibration may be suppressed, that is, any signal for producing a torque pattern of the first-order component of the load torque of the compressor, or of a composition of the first-order component and the second-order component of the same, or a composition of the first-to n-th order components of the same. FIG. 18 is a diagram showing the Fourier development of components from the first-order component to the third-order component of the load torque in the case where the compressor is driven under a certain pressure condition. The curves A, B, and C represent the first-, the second-, and the third-order components respectively. Further, in FIG. 18, a reference level for judging whether the level is positive or negative has a value of the zero-order component. Further, FIG. 19 shows a difference between the load torque of the compressing element and the output torque of the electromotive component, and the curves a, b, and c represent the respective differences between the load torque and the output torque in the case where the output torque of the electromotive element is not controlled, in the case where the first-order component shown by the curve A in FIG. 18 is produced as the output torque, and in the case where the torque pattern obtained by composing the first and second-order components shown by the curves A and B in FIG. 18 respectively is produced as the output torque. As seen from FIG. 19, as compared with the case where the torque control of the electromotive element is not performed at all (shown by the curve a), in the case where the output torque control is performed (shown by the curves b and c), the residue torque (the difference between the load and output torques) acting on the revolutional system of the compressor is made smaller than that in the case where the torque control is not performed, and therefore even in the case where the torque pattern corresponding to only the first-order component is produced from the electromotive element (shown by the curve b), a revolutional vibration reducing effect can be obtained. Further, although it is more preferable to use a torque pattern composed of components from the first-order to the n-th order, a sufficient effect is can be obtained in practical use by using a torque pattern composed of the first-order and the second-order components, or the like. Moreover, it is possible to arrange the circuit so as to desirably use a selected one of a plurality of torque patterns composed of the components from the first-order to the n-th order components ($n = 1 \sim n$).

We claim:

1. A motor-driven compressor comprising:

an electric motor having a rotor;

a compressor driven by said electric motor through a main shaft connected to said rotor;

a revolution velocity control means for supplying said electric motor with a current to rotate said rotor and for desiredly changing the revolutional frequency of said rotor;

a current detection circuit for detecting a current to said electric motor;

means for measuring a necessary time required for rotating each of unit angles obtained by equally dividing one rotation of the rotor of said electric motor;

a comparison/operation circuit for operating a necessary time obtained by said measuring means; and a torque control means for forming a signal for controlling the output torque of said electric motor so as to make the difference between the measured necessary time obtained by said comparison/operation circuit and a reference value of the necessary time substantially zero and for supplying the signal to said revolution velocity control means, whereby said comparison/operation circuit obtains the difference between the measured necessary time and the reference value of the necessary time and operates a command current value for said electric motor so that the difference becomes zero, and said torque control means compares a current measured by said current detection circuit with the command current value and forms a signal for changing a current supplied to said electric motor so that the difference between the command current value and said measured current value becomes zero, and transmits the signal to said revolution velocity control means.

2. A motor-driven compressor comprising:

an electric motor having a rotor and a stator;

a rotary compressor having a casing and a rotor connected to said electric motor through a main shaft connected to the rotor of said electric motor;

a revolution velocity control means for supplying said electric motor with a current to rotate the rotor of said electric motor and for desiredly changing the revolutional frequency of the rotor of said electric motor;

a current detection means for detecting a current supplied to said electric motor and for producing a signal indicative of a current value thereof;

a detecting means including a gear-like disk fixed to said main shaft and provided with a plurality of regularly arranged protrusions and a contactless switch disposed in opposition to said protrusions of said disk for producing an AC signal corresponding to repetition of successive approaching to said protrusions, for detecting time required for said main shaft to rotate said plurality of protrusions of said disk one by one successively;

operation circuit means for obtaining a difference between the required time detected by said detecting means and a reference required time, and for producing a command current value necessary for generating an output torque agreeing with a load torque for performing compression in accordance with the obtained difference; and a torque control means for comparing said command current value and said detected current value and for producing a signal for controlling output torque of said electric motor in accordance with an obtained difference so as to make the output torque of said electric motor agree with load torque required for performing compression, said torque control means transmitting said produced signal to said revolution velocity control means.

3. A motor-driven compressor according to claim 2, in which said torque control means operates such that a revolution angle region of said main shaft in a period during which a compressing operation is once performed is divided into a plurality of divisional revolution angular regions the number of which is equal to a product of the number of magnetic poles of said electric motor and the number of phases of the same, the difference between the detected required time and said reference required time is obtained in each of said divisional revolution angular regions, and said signal for controlling output torque of said electric motor is formed in accordance with the obtained time difference so as to make the output torque of said electric motor agree with load torque required for performing compression.

4. A motor-driven compressor according to claim 2, in which said torque control means operates such that the angle of one revolution of said main shaft is divided into a plurality of divisional revolution angular regions, the difference between the detected required time and said reference required time is obtained in each of said divisional revolution angular regions, and said signal for controlling output torque of said electric motor is formed in accordance with the obtained time difference so as to make the output torque of said electric motor agree with load torque required for performing compression.

5. A motor-driven compressor according to claim 4, in which each of said divisional revolution angular regions is further divided into a detection region and a torque control region successive to said detection region, so that the angular velocity is detected in said detection region and the output torque of said electric motor is controlled in said torque control region.

6. A motor-driven compressor according to claim 4, in which said torque control means controls the output torque of said electric motor within a range of revolutional frequency from 700 r.p.m. to 2000 r.p.m.

7. A motor-driven compressor provided with an electric motor having a rotor and a stator, a compressor driven by said electric motor through a main shaft connected to the rotor of said electric motor, a closed casing containing said electric motor and said compressor, and a revolution velocity control means for supplying said electric motor with a current to rotate the rotor of said electric motor and for desiredly changing the revolutional frequency of the rotor of said electric motor; the imporvement comprises:

current detecting means for detecting a current supplied to said electric motor and for producing a signal indicative of a current value thereof;

angular velocity detecting means for detecting a velocity of said main shaft per unit revolution angle including a disk fixed to said main shaft and provided with a plurality of regularly arranged protrusions, and switching means disposed in opposition to said protrusions for producing an AC signal corresponding to repetition of successive approaching to said protrusions;

operation circuit means for obtaining a difference between the angular velocity of said main shaft detected by said angular velocity detecting means and a reference angular velocity for providing a command current value necessary for generating an output torque agreeing with load torque required for performing compression in accordance with the obtained difference; and a torque control means for comparing said command current value with said detected current value and for producing a signal for controlling output torque of said electric motor so as to make substantially zero a difference between load torque required for compression of said compressor and output torque of said electric motor in any revolution angular position of said main shaft, said torque control means transmitting said produced signal to said revolution velocity control means.

8. A motor-driven compressor according to claim 7, in which said torque control means operates to detect a deviation in revolution velocity of said main shaft and control the output torque of said electric motor so as to make substantially zero the detected deviation in revolution velocity.

9. A motor-driven compressor according to claim 7, in which said torque control means operates to detect an acceleration in the revolutional direction caused in a non-rotary portion in one of said compressor and said electric motor and control the output torque of said electric motor so as to make substantially zero the detected acceleration in the revolutional direction.

10. A motor-driven compressor according to claim 7, in which said torque control means operates such that a revolution angle region of said main shaft is a period during which a compressing operation is once performed is divided into a plurality of divisional revolution angular regions the number of which is equal to a product of the number of magnetic poles of said electric motor and the number of phases of the same, the difference between the angular velocity of said main shaft and said reference angular velocity is obtained in each of said divisional revolution angular regions, and said signal for controlling output torque of said electric motor is formed in accordance with the obtained difference so as to make the output torque of said electric motor agree with load torque required for performing compression.

11. A motor-driven compressor according to claim 7, in which said torque control means operates such that the angle of one revolution of said main shaft is divided into a plurality of divisional revolution angular regions, the difference between the angular velocity of said main shaft and said reference angular velocity is obtained in each of said divisional revolution angular regions, and said signal for controlling output torque of said electric motor is formed in accordance with the obtained difference so as to make the output torque of said electric motor agree with load torque required for performing compression.

12. A motor-driven compressor according to claim 11, in which each of said divisional revolution angular regions is further divided into a detection region and a torque control region successive to said detection region, so that the angular velocity is detected in said detection region and the output torque of said electric motor is controlled in said torque control region.

13. A motor-driven compressor according to claim 7, in which said torque control means has capability of giving said electric motor instructions of a plurality of patterns of the output torque for one cycle corresponding to one revolution of said main shaft.

14. A motor-driven compressor according to claim 13, in which each of said electric motor output torque patterns is a pattern of a single component in accordance with the degree of revolution relative to load torque of said compressor.

15. A motor-driven compressor according to claim 14, in which the output torque of said electric motor is produced stepwise during one revolution of said main shaft successively in equidivisional steps the number of which is equal to a product of the respective numbers of poles and phases of said electric motor.

16. A motor-driven compressor comprising:

an electric motor having a rotor and a stator;

a compressor driven by said electric motor through a main shaft connected to said rotor;

a revolution velocity control means for supplying said electric motor with a current to rotate said rotor an for desiredly changing the revolutional frequency of said rotor;

a current detection means for detecting a current supplied to said electric motor and for producing a signal indicative of a current value thereof;

an angular velocity detecting means for detecting a velocity of said main shaft per unit revolution angle, said angular velocity detecting means including a disk fixed to said main shaft and provided with a plurality of regularly arranged protrusions, and a switching element disposed in opposition to said protrusions of said disk for producing an AC signal corresponding to repetition of successive approaching to said protrusions;

an operation circuit for obtaining a difference between the angular velocity of said main shaft detected by said angular velocity detecting means and a reference angular velocity and for providing a command current value necessary for generating an output torque agreeing with a load torque for performing compression in accordance with the obtained difference; and a torque control means for comparing said command current value provided by said operation circuit with the current value detected by said current detection means and for forming a signal for changing said current value so that a difference between said command current value and said current value becomes zero and for transmitting the signal to said revolution velocity control means so as to make the output torque of said electric motor substantially agree with the load torque.

17. A motor-driven compressor according to claim 16, in which said torque control means operates such that the angle of one revolution of said main shaft is divided into a plurality of divisional revolution angular regions, the difference between the angular velocity of said main shaft and said reference angular velocity is obtained in each of said divisional revolution angular regions, and said signal for controlling output torque of said electric motor is formed in accordance with the obtained difference so as to make the output torque of said electric motor agree with load torque required for performing compression.

18. A motor-driven compressor according to claim 17, in which each of said divisional revolution angular regions is further divided into a detection region and a torque control region successive to said detection region, so that the angular velocity is detected in said detection region and the output torque of said electric motor is controlled in said torque control region.

19. A motor-driven compressor according to claim 16, in which said torque control means operates such that a revolution angle region of said main shaft in a period during which a compressing operation is once performed is divided into a plurality of divisional revolution angular regions the number of which is equal to a product of the number of magnetic poles of said electric motor and the number of phases of the same, the difference between the angular velocity of said main shaft and said reference angular velocity is obtained in each of said reference angular velocity is obtained in each of said divisional revolution angular regions, and said signal for controlling output torque of said electric motor is formed in accordance with the obtained difference so as to make the output torque of said electric motor agree with load torque required for performing compression.

20. A motor-driven compressor according to claim 19, in which each of said divisional revolution angular regions is further divided into a detection region and a torque control region successive to said detection region, so that the angular velocity is detected in said detection region and the output torque of said electric motor is controlled in said torque control region.

* * * * *